United States Patent [19]

Newman

[11] Patent Number: 4,826,461

[45] Date of Patent: May 2, 1989

[54] PROPELLER PROTECTOR

[75] Inventor: Neil A. Newman, Omro, Wis.

[73] Assignee: Brunswick Corporation, Skokie, Ill.

[21] Appl. No.: 117,998

[22] Filed: Nov. 6, 1987

[51] Int. Cl.[4] ..... B63H 5/16

[52] U.S. Cl. ..... 440/71; 440/72

[58] Field of Search ..... 440/71, 72, 49, 66, 440/73; 114/337, 338, 361, 343

[56] References Cited

U.S. PATENT DOCUMENTS

| | | | |
|---|---|---|---|
| 2,054,374 | 9/1936 | Fuller | 440/71 |
| 2,135,162 | 11/1938 | Benson | 440/72 |
| 2,244,217 | 6/1941 | Pries | 440/72 |
| 2,319,640 | 5/1943 | Sink | 440/72 |
| 2,470,874 | 5/1949 | Sidney | 440/71 |
| 2,894,477 | 7/1959 | Brown | 440/71 |
| 3,025,825 | 3/1962 | Martinson | 440/71 |
| 3,035,538 | 5/1962 | Willard | 440/72 |
| 3,859,953 | 1/1975 | Todt | 440/72 |
| 4,235,183 | 11/1980 | Evinrude | 440/71 |
| 4,445,452 | 5/1984 | Loch | 114/282 |
| 4,565,533 | 1/1986 | Springer | 440/71 |
| 4,637,801 | 1/1987 | Schultz | 440/67 |
| 4,680,017 | 7/1987 | Eller | 440/66 |

*Primary Examiner*—Joseph F. Peters, Jr.
*Assistant Examiner*—Clifford T. Bartz
*Attorney, Agent, or Firm*—Andrus, Sceales, Starke & Sawall

[57] ABSTRACT

A propeller protector (26) is provided by a two piece hub structure (28, 30). Each piece has an inner arcuate portion (32, 34) substantially conforming to the side of the torpedo housing (14) of the marine drive. Each piece has a pair of fins (40 and 42, 44 and 46) extending radially outwardly from the inner arcuate portion and spaced axially forward of the propeller (20). Top rear, bottom rear and front clamps (48, 50 and 52) mount the two pieces (28 and 30) to the torpedo housing on opposite sides (36, 38) thereof.

13 Claims, 3 Drawing Sheets

PROPELLER PROTECTOR

BACKGROUND AND SUMMARY

The invention relates to propeller protectors for marine drives.

Propeller protectors are known in the art, for example as shown in U.S. Pat. Nos. 2,054,374, 2,470,874, 4,235,183, 4,445,452, 4,565,533, 4,637,801, and 4,680,017.

The present invention provides a particularly simple and effective propeller protector which may be added to a conventional marine drive.

DETAILED DESCRIPTION

Figure 1:
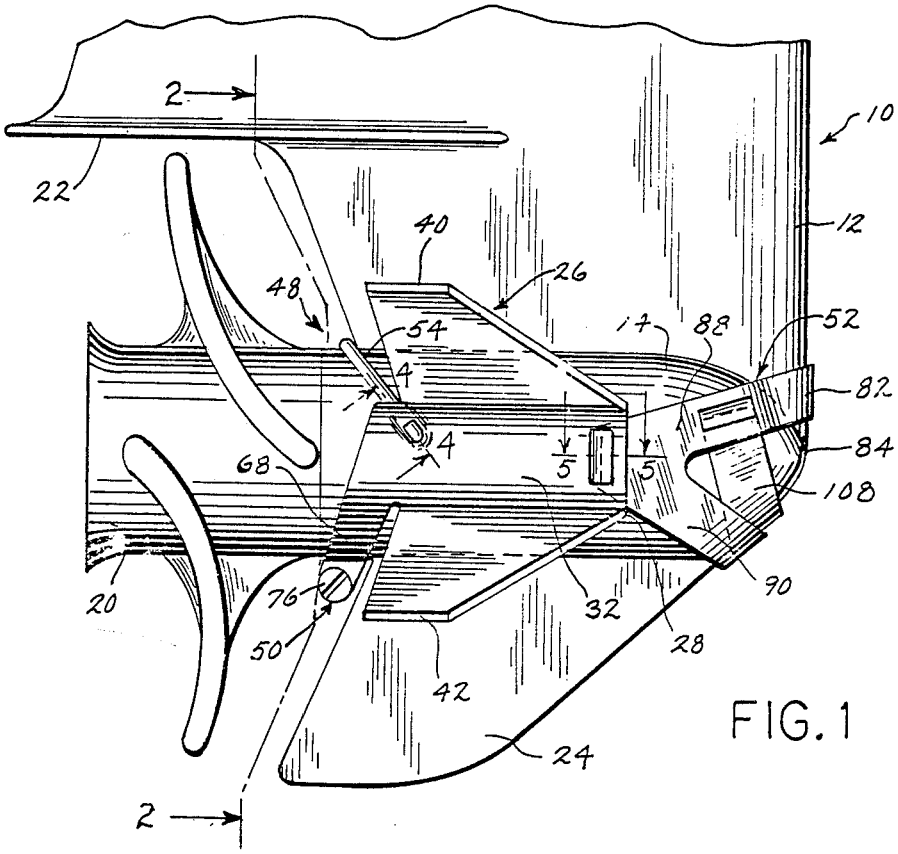
FIG. 1 is a side elevational view of a marine drive with a propeller protector in accordance with the invention.
Figure 2:
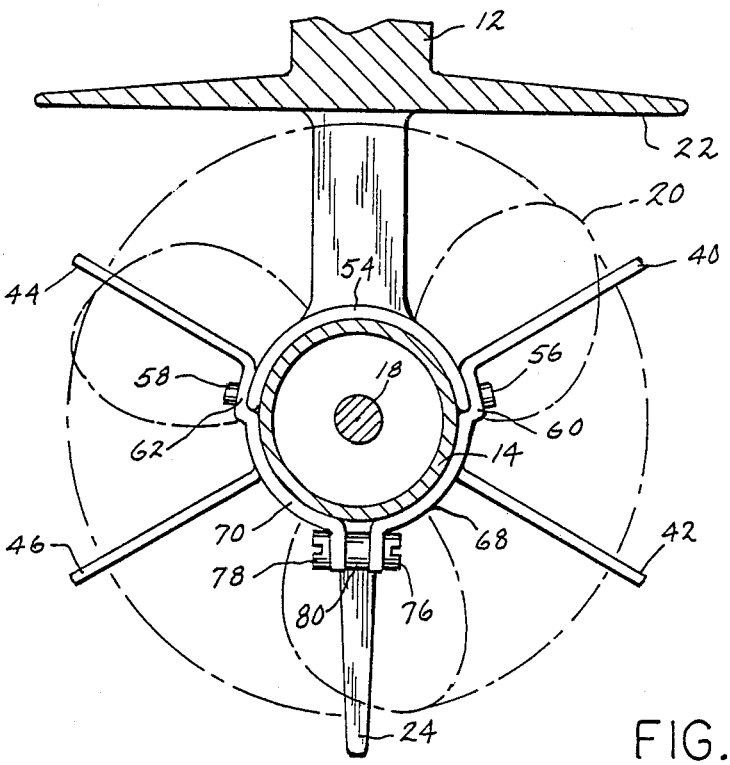
FIG. 2 is a sectional view taken along line 2—2 of FIG. 1.

FIG. 1 shows a portion of a marine drive 10 having a depending gearcase 12 with a lower submerged torpedo housing 14. The gearcase has a vertical driveshaft 16, FIG. 3, driving a horizontal propeller shaft 18 carrying a propeller 20 at the back end of the torpedo housing. The gearcase includes anticavitation plate 22 above the propeller, and skeg 24 extending downwardly from the torpedo housing.

Figure 3:
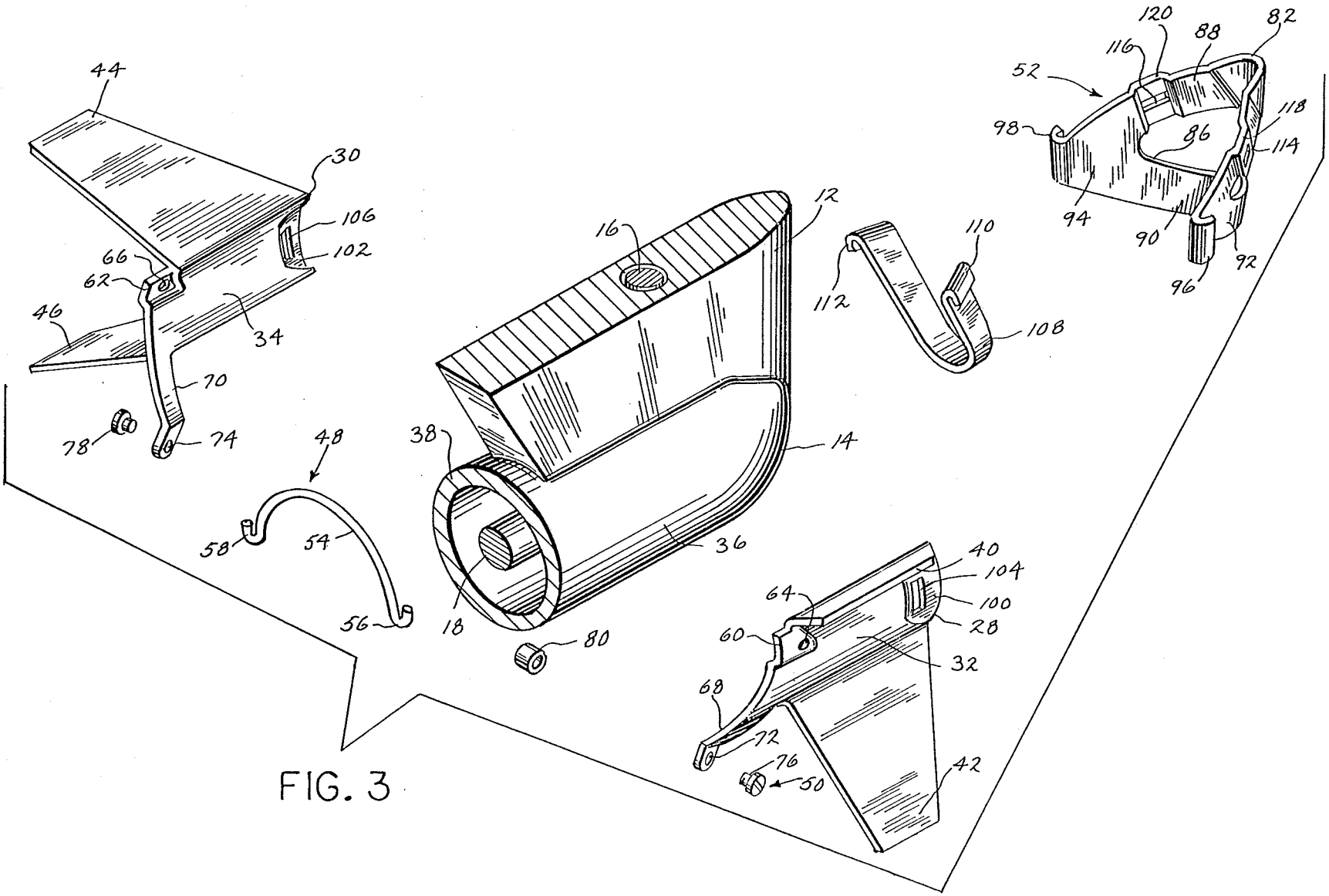
FIG. 3 is an exploded perspective view of a portion of the structure of FIG. 1, and schematically shows portions of the gearcase.

A propeller protector 26 is provided by a two piece hub structure 28 and 30, FIG. 3. Pieces 28 and 30 are stamped or cast metal. Each piece has an inner arcuate portion 32, 34, substantially conforming to the respective sides 36 and 38 of torpedo housing 14. Each piece has a pair of fins 40 and 42, 44 and 46, respectively, extending radially outwardly from respective inner arcuate portions 32 and 34. Mounting structure, including top rear clamp 48, bottom rear clamp 50, and front clamp 52, mount the two pieces 28 and 30 on torpedo housing 14 on opposite sides 36 and 38 thereof such that the inner arcuate portions 32 and 34 of the pieces engage and nest against the torpedo housing in conformity therewith, and such that fins 40, 42, 44 and 46 extend radially outwardly from such hub structure and are spaced axially forward of propeller 20 and deflect debris which might otherwise strike the propeller.

Figure 4:
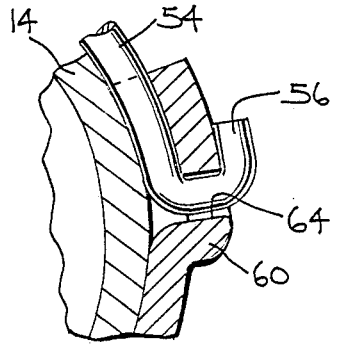
FIG. 4 is a sectional view taken along line 4—4 of FIG. 1.

Top rear clamp 48 extends along the top of the torpedo housing rearwardly of gearcase 12 and is attached to each of pieces 28 and 30. Clamp 48 is provided by a curved metal wire or rod member 54 having hook-shaped ends 56 and 58, FIG. 3. Inner arcuate portions 32 and 34 of the hub structure have top rear hooking configurations provided by outwardly bulged shoulders 60 and 62 having respective apertures 64 and 66 therethrough. Wire member 54 extends along the top of the torpedo housing rearwardly of gearcase 12, and hook-shaped ends 56 and 58 are received in respective apertures 64 and 66, FIG. 4.

Bottom rear clamp 50 extends along the bottom of the torpedo housing rearwardly of skeg 24 and is attached to each of pieces 28 and 30. Pieces 28 and 30 have bottom rear hooking configurations provided by respective legs 68 and 70 extending downwardly from respective arcuate portions 32 and 34 partially around the bottom of the torpedo housing and having respective apertures 72 and 74 at the ends thereof joined by clamp 50 provided by a pair of fastening bolts 76 and 78 extending through such apertures and threaded into an intermediate internally threaded spacer member 80.

Figure 5:
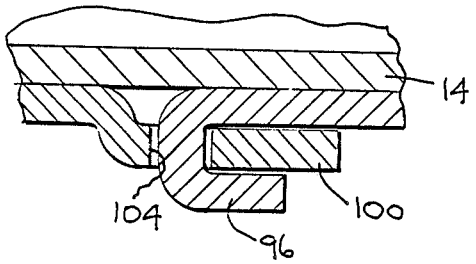
FIG. 5 is a sectional view taken along line 5—5 of FIG. 1.

Front clamp 52 is provided by an integral metal nose piece 82 connected to each piece 28 and 30 of the hub structure and extending forwardly therefrom around the front of the torpedo housing. Torpedo housing 14 has a bullet-like shape with a front central leading nose tip 84. Nose piece 82 has an opening 86 therethrough receiving nose tip 84 therein. Nose piece 82 has an upper strap portion 88 extending around the front of the torpedo housing and the gearcase above nose tip 84, and has a lower strap portion 90 extending around the front of the torpedo housing and skeg 24 below nose tip 84. Upper and lower strap portions 88 and 90 are joined at side yoke portions 92 and 94 having respective hook-shaped ends 96 and 98. Arcuate portions 32 and 34 of hub structure pieces 28 and 30 have front hooking configurations provided by outwardly bulged respective shoulders 100 and 102 having respective apertures 104 and 106 receiving respective hook-shaped ends 96 and 98, FIG. 5.

A metal cross-over strap 108 is connected to the upper strap portion 88 of the nose piece at a point between hub structure pieces 28 and 30 and the front of upper strap portion 88, and extends from upper strap portion 88 downwardly around the bottom of the front of torpedo housing 14 below nose tip 84, for added support. Cross-over strap 108 has upper hook-shaped ends 110 and 112 received in respective apertures 114 and 116 in respective bulged out shoulders 118 and 120 in upper strap portion 88.

Figure 6:
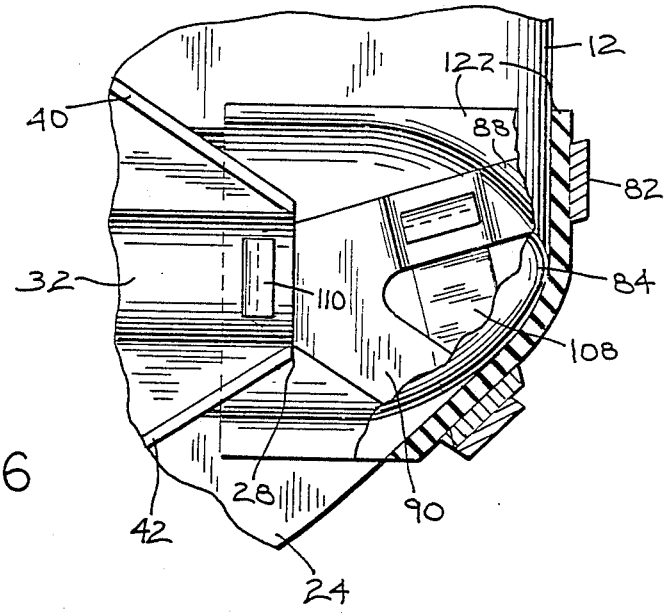
FIG. 6 shows a portion of the structure of FIG. 1 and illustrates an alternate embodiment.

In a further embodiment, a rubber or plastic sock 122, FIG. 6, is fitted over the front of the torpedo housing to cushion the front of the torpedo housing from damage by impacting debris, and also to prevent fretting of the torpedo housing with front clamp nose piece 82. Sock 122 may alternatively extend all the way to the back of the torpedo housing to also prevent fretting of the torpedo housing with inner arcuate portions 32 and 34 of hub structure pieces 28 and 30.

During assembly of the propeller protector to the torpedo housing, front clamp 52 is initially hooked to pieces 28 and 30 and slid over nose tip 84, followed by hooking of clamp 48 to pieces 28 and 30, and the assembly is then secured and tightened to the torpedo housing by fastener clamp 50.

It is recognized that various equivalents, alternatives and modifications are possible within the scope of the appended claims.

I claim:

1. In a marine drive having a depending gearcase with a lower submerged torpedo housing having a propeller shaft carrying a propeller at the back end of said torpedo housing, the improvement comprising a propeller protector comprising hub structure having a plurality of fins extending radially outwardly therefrom, and clamp means mounting said hub structure to said torpedo housing with clamping tension applied both around said torpedo housing and front to back along said torpedo housing and such that said fins extend radially outwardly from said hub structure, said fins being spaced axially forward of said propeller and deflecting debris which might otherwise strike said propeller.

2. In a marine drive having a depending gearcase with a lower submerged torpedo housing having a propeller shaft carrying a propeller at the back end of said torpedo housing, the improvement comprising a propeller protector comprising hub structure having a plurality of fins extending radially outwardly therefrom, and means mounting said hub structure to said torpedo housing such that said fins extend radially outwardly from said hub structure, said fins being spaced axially forward of said propeller and deflecting debris which might otherwise strike said propeller, wherein said means mounting said hub structure to said torpedo housing comprises first clamp means extending along the top of said torpedo housing rearwardly of said gearcase and attached to said hub structure, second clamp means extending along the bottom of said torpedo housing and attached to said hub structure, and third clamp means extending around the front of said torpedo housing and attached to said hub structure.

3. The invention according to claim 2 comprising a skeg extending downwardly from said torpedo housing, and wherein said second clamp means extends along the bottom of said torpedo housing rearwardly of said skeg.

4. The invention according to claim 2 wherein said torpedo housing has a bullet-like shape with a front central leading nose tip, and wherein said third clamp means comprises a first strap portion extending around the front of said torpedo housing above said nose tip, and a second strap portion extending around the front of said torpedo housing below said nose tip.

5. The invention according to claim 4 comprising a cross-over strap connected to said first strap portion at a point between said hub structure and the front of said first strap portion, said cross-over strap extending from said first strap portion downwardly and around the bottom of the front of said torpedo housing below said nose tip.

6. The invention according to claim 2 comprising a cushioning resilient sock fitted over at least the front of said torpedo housing to cushion the front of said torpedo housing from damage by impacting debris and also to prevent fretting of said torpedo housing with said third clamp means.

7. In a marine drive having a depending gearcase with a lower submerged torpedo housing having a propeller shaft carrying a propeller at the back end of said torpedo housing, the improvement comprising a propeller protector comprising hub structure having a plurality of fins extending radially outwardly therefrom, front clamp means comprising an integral nose piece connected to said hub structure and extending forwardly therefrom around the front of said torpedo housing, top rear clamp means connected to said hub structure and extending around the top of said torpedo housing rearwardly of said gearcase, and bottom rear clamp means connected to said hub structure and extending around the bottom of said torpedo housing, said front clamp means together with said top rear clamp means together with said bottom rear clamp means in combination applying clamping tension both around said torpedo housing and front to back along said torpedo housing.

8. The invention according to claim 7 wherein said torpedo housing has a bullet-like shape with a front central leading nose tip, and wherein said nose piece has an opening therethrough receiving said nose tip therein.

9. In a marine drive having a depending gearcase with a lower submerged torpedo housing having a propeller shaft carrying a propeller at the back end of said torpedo housing, the improvement comprising a propeller protector comprising a two piece hub structure, each piece having an inner arcuate portion substantially conforming to the side of said torpedo housing, each piece having a pair of fins extending radially outwardly from said inner arcuate portion, and means mounting said two pieces to said torpedo housing on opposite sides thereof such that said inner arcuate portions of said pieces engage and nest against said torpedo housing in conformity therewith.

10. The invention according to claim 9 wherein each of said arcuate portions has a hooking configuration at the top rear, bottom rear, and front thereof, and wherein said mounting means comprises a first clamp connected between said top rear hooking configurations and extending along the top of said torpedo housing rearwardly of said gearcase, a second clamp connected between said bottom rear hooking configurations and extending along the bottom of said torpedo housing, and a third clamp connected between said front hooking configurations and extending around the front of said torpedo housing.

11. The invention according to claim 10 wherein said first clamp comprises a wire member having hook-shaped ends, and wherein said top rear hooking configurations comprise an aperture at the top rear of each of said inner arcuate portions of said two pieces receiving said hook-shaped ends of said wire, and wherein said bottom rear hooking configurations comprise a pair of legs extending downwardly from respective said arcuate portions partially around the bottom of said torpedo housing and having apertures at the ends thereof joined by a fastening bolt, and wherein said third clamp comprises strap means having hook-shaped ends, and wherein said front hooking configurations comprise an aperture at the front of each of said inner arcuate portions of said two pieces receiving said hook-shaped ends of said strap means.

12. In a marine drive having a depending gearcase with a lower submerged torpedo housing having a propeller shaft carrying a propeller at the back end of said torpedo housing, the improvement comprising a propeller protector comprising hub structure conforming to and wrapping partially around said torpedo housing and having a plurality of fins extending radially outwardly therefrom, and means mounting said hub structure to said torpedo housing such that said fins extend radially outwardly from said hub structure, said fins being spaced axially forward of said propeller and deflecting debris which might otherwise strike said propeller, wherein said means mounting said hub structure to said torpedo housing comprises first clamp means extending along the top of said torpedo housing rearwardly of said gearcase and attached to said hub structure, second clamp means extending along the bottm of said torpedo housing and attached to said hub structure, and third clamp means extending around the front of said torpedo housing and attached to said hub structure.

13. In a marine drive having a depending gearcase with a lower submerged torpedo housing having a propeller shaft carrying a propeller at the back end of said torpedo housing, the improvement comprising a propeller protector comprising hub structure having a plurality of non-resilient fins extending radially outwardly therefrom, and means mounting said hub structure to said torpedo housing such that said non-resilient fins extend radially outwardly from said hub structure, said non-resilient fins being spaced axially forward of said propeller and deflecting debris which might otherwise strike said propeller, and protecting said propeller from impacting substantial obstacles, wherein said fins are generally flat planar sheet-like plates.

* * * * *